US009389052B2

(12) United States Patent
Conroy et al.

(10) Patent No.: US 9,389,052 B2
(45) Date of Patent: Jul. 12, 2016

(54) JACKETED BULLET

(71) Applicant: U.S. Army Research Laboratory, Washingon, DC (US)

(72) Inventors: Paul J. Conroy, Churchville, MD (US); Daniel R. Gubernat, Bridgewater, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 14/029,847

(22) Filed: Sep. 18, 2013

(65) Prior Publication Data

US 2014/0326157 A1 Nov. 6, 2014

(51) Int. Cl.

| | |
|---|---|
| ***F41A 21/18*** | (2006.01) |
| ***F42B 12/08*** | (2006.01) |
| ***F42B 12/74*** | (2006.01) |
| ***F42B 12/78*** | (2006.01) |
| ***F42B 30/02*** | (2006.01) |

(52) U.S. Cl.

CPC ..... *F42B 12/08* (2013.01); *F41A 21/18* (2013.01); *F42B 12/74* (2013.01); *F42B 12/78* (2013.01); *F42B 30/02* (2013.01)

(58) Field of Classification Search

CPC ..... F42B 12/72; F42B 12/74; F42B 12/76; F42B 12/78; F42B 12/80; F42B 12/06

USPC ..... 102/517, 518, 519

See application file for complete search history.

(56) References Cited

U.S. PATENT DOCUMENTS

| | | | | | |
|---|---|---|---|---|---|
| 804,483 | A * | 11/1905 | Lincoln | F41A 21/16 | 42/78 |
| 2,498,052 | A * | 2/1950 | Smith | F41A 21/04 | 42/78 |
| 3,277,825 | A * | 10/1966 | Maillard | 102/374 | |
| 4,932,326 | A * | 6/1990 | Ladriere | 102/364 | |
| 6,598,536 | B2 * | 7/2003 | Burri | 102/522 | |
| 6,889,612 | B1 * | 5/2005 | Liaw | F41A 21/18 | 102/346 |
| 2011/0252997 | A1 * | 10/2011 | Hoffman | 102/439 | |

* cited by examiner

*Primary Examiner* — Stephen M Johnson
(74) *Attorney, Agent, or Firm* — Alan I. Kalb

(57) ABSTRACT

A jacketed bullet having a penetrator constructed of a hard material in line with a slug having a lower modulus. At least a portion of both the slug and the penetrator are then encased by a metal jacket. A plurality of circumferentially spaced and axially extending flutes are formed along the slug and possibly the penetrator. These flutes receive deformation of the jacket upon firing of the bullet into a rifled gun bore to thereby reduce friction between the bullet and the gun bore during operation.

4 Claims, 3 Drawing Sheets

JACKETED BULLET

GOVERNMENT INTEREST

The invention described herein may be manufactured, used, and licensed by or for the United States Government.

BACKGROUND OF THE INVENTION

I. Field of the Invention

The present invention relates generally to a jacketed bullet.

II. Description of Related Art

Jacketed bullets are used in a wide range of firearms in both military and nonmilitary applications. In a jacketed bullet a penetrator constructed of a had material forms the tip of the bullet. A slug constructed of a material having a lower modulus is then positioned behind the penetrator and at least a portion of both the slug and the penetrator are encased in a metal jacket. The jacketed bullet is then assembled into a cartridge with a propelling charge and primer.

In order to improve the stability and accuracy of the bullet, most firearms today include a rifled bore. A rifled bore extends in a helical fashion along at least a portion of the barrel. During launch of the bullet, the rifling in the barrel imparts spin to the bullet which increases the accuracy of the firearm.

In order to ensure proper operation of the rifling and to minimize leakage of the gasses from the firing of the bullet, the outside diameter of the jacket is slightly greater than the inside diameter of the rifling. Consequently, when the bullet is loaded into the chamber, the barrel rifling engages the outer surface of the jacket and radially inwardly compresses or "engraves" the jacket. Such engraving creates a slight elongation of the slug and effectively requires energy to plastically deform the bullet. This deformation energy and related frictional losses reduces the overall muzzle velocity of the firearm.

Historically lead has been used as the material for the slug because it has a low modulus of elasticity with respect to almost every other metal and is easily deformed. Consequently, the energy stored in the bullet by engraving is very low and only minimally affects the muzzle velocity of lead core bullets.

The use of lead as the material for the slug, however, creates other problems. For example, in shooting ranges the lead content in the ground around the range may result in an unacceptable lead toxicity.

Consequently, other materials have recently been used for the slug. These other materials include, for example, copper, brass, bronze, zinc, steel, and other materials. All of these other materials, however, have an elastic modulus greater than the modulus of lead.

Thus, when using a jacketed bullet with a nonlead slug, the bullet exhibits a greater resistance to deformation during engraving as the bullet is fired. This, in turn, increases the overall work required to engrave the bullet when fired, compared to a jacketed bullet with a lead slug, which requires less deformation work to engrave the bullet during firing. This reduction of energy during firing results in a reduced bullet velocity upon exit from the gun barrel assuming, of course, all other factors are equal.

SUMMARY OF THE PRESENT INVENTION

The present invention provides a jacketed bullet which overcomes the above mentioned disadvantages of the previously known jacketed bullets.

In brief, the jacketed bullet of the present invention comprises a penetrator constructed of a hard material. A slug is axially aligned with the penetrator and this slug is constructed of a nonlead material, such as copper, bronze, zinc, steel, iron, tin and or alloys thereof. At least a portion of both the penetrator as well as the slug are encased with a metal jacket thus forming the bullet. Unlike the previously known jacketed bullets, however, in the present invention at least one and preferably a plurality of longitudinally extending flutes are formed along the outer surface of the slug. Flutes may be oriented with the axis of the bore or be swept helically in such a fashion as to match the rifling of the barrel or be progressive to begin straight and eventually match the rifling of the barrel. These flutes thus present a relief volume within the interior of the bullet into which the metal jacket can deform when the metal jacket is engraved upon firing the bullet.

By allowing the jacket to deform into the flutes during engraving, the elongation of the bullet which would otherwise be caused by engraving is minimized or altogether eliminated. This, in turn effectively reduces the energy stored in the bullet caused by engraving and reduces the contact force and friction between the bullet and the rifle bore during launch. Such reduced friction increases the muzzle velocity of the bullet to the same levels as metal jacket bullets with lead slugs, assuming all else remains the same.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
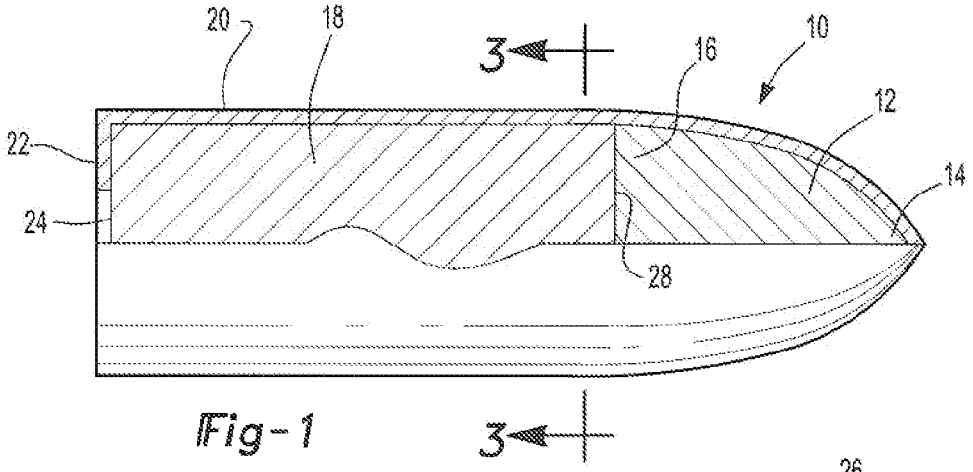
FIG. 1 is a longitudinal partial sectional view illustrating a preferred embodiment of the present invention.

With reference first to FIG. 1, a longitudinal partial sectional view of a bullet 10 according to the present invention is shown. The bullet 10 includes a penetrator 12 which narrows to a point 14 at the front of the bullet 10. A base 16 of the penetrator 12 is generally cylindrical in shape. Portions of the penetrator 12 may or may not be exposed from the jacket 20 at the tip.

The penetrator 12 may be made of any hard material such as tungsten, carbide steel, steel, depleted uranium, and the like. Furthermore, the penetrator 12 is of standard construction for jacketed bullets.

A slug 18 is generally cylindrical in shape and is axially aligned with the base 16 of the penetrator 12. The slug 18 may be constructed of any conventional material including those materials with an elastic modulus higher than lead. Consequently, bronze, brass, copper, zinc, steel, iron, tin, bismuth, as well as alloys thereof may be used as the material for the slug 18. Still referring to FIG. 1, at least a portion of the slug 18 and penetrator 12 are encased in a metal jacket 20. The metal jacket 20 illustrated in FIG. 1 is a full metal jacket and is secured to the slug 18 and penetrator 16 by a crimp 22 at a rear end 24 of the slug 18. Or the metal jacket 18 could be a reverse crimp jacket leaving the tip part of the penetrator exposed.

Figure 2:
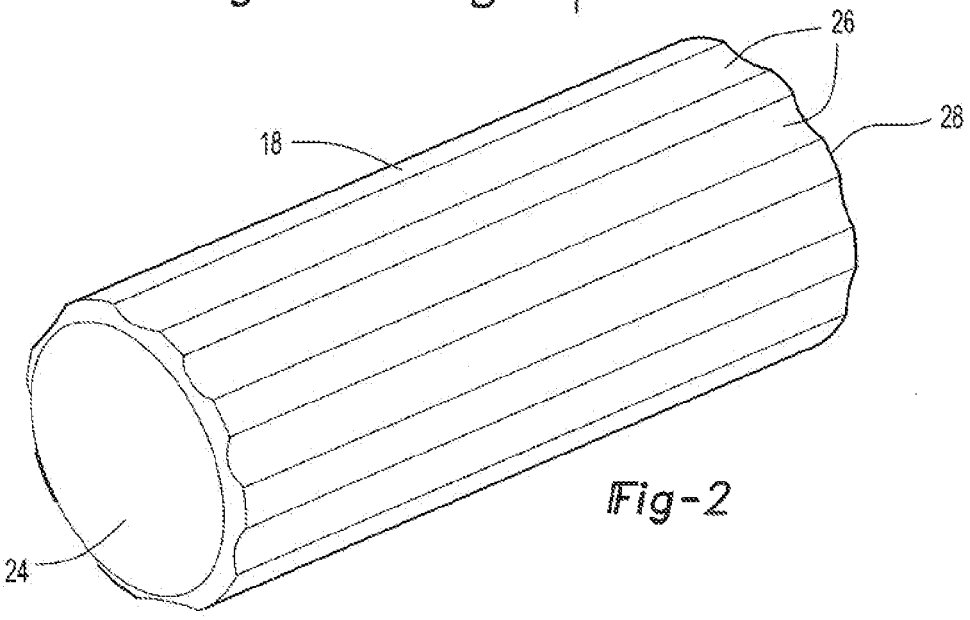
FIG. 2 is a longitudinal view illustrating the slug for a preferred embodiment of the invention.

With reference now to FIG. 2, unlike the previously known slugs, the slug 18 according to the present invention has at least one flute 26, and preferably several circumferentially equidistantly spaced flutes 26, which extend longitudinally from a front end 28 of the slug 18 and to its rear end 24. The flutes 26 may extend along the entire length of the slug 18 or as shown in FIG. 2, along only a portion of the axial length of the slug 18. The cross-sectional shape of the flutes 26, furthermore, may have a flat bottom 30 as shown in FIG. 3 or other shapes.

Figure 3:
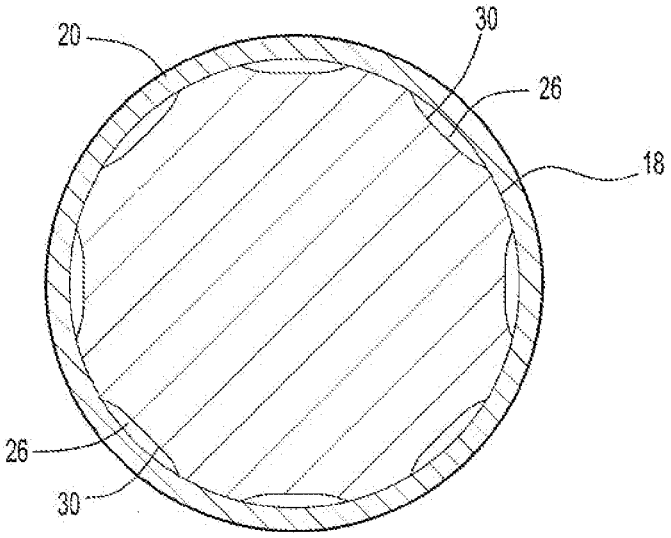
FIG. 3 is a sectional view taken substantially along line 3-3 in FIG. 1.
Figure 4:
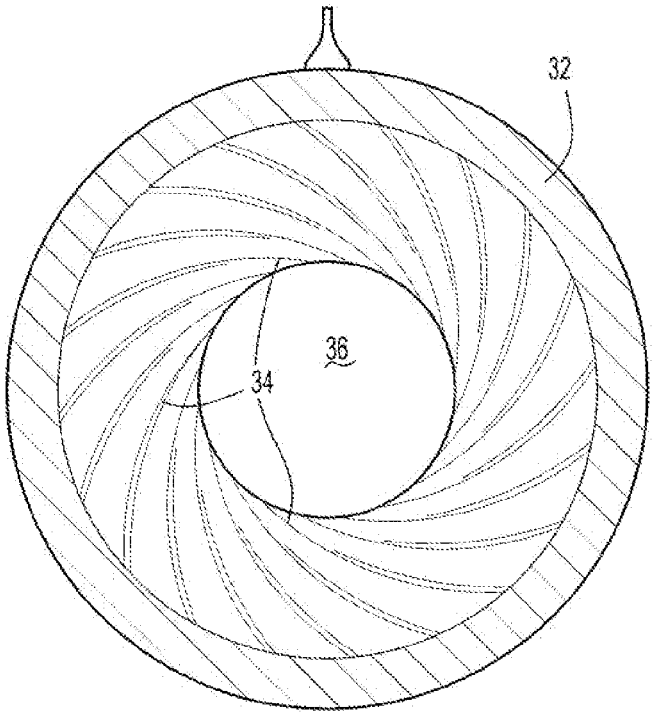
FIG. 4 is a partial end view illustrating a gun barrel with rifling.

With reference now to FIGS. 3 and 4, a gun barrel 32 includes rifling 34 along at least a portion of the gun bore 36. The depth of the flutes 26 in the slug 18 is substantially the same as the radial length of the rifling 34. Consequently, when the bullet 10 is fired in the gun barrel 32 so that the rifling 34 engraves the outer surface of the jacket 20, the jacket 20 deforms into the flutes 26 and minimizes elongation and other strain energy imparted to the slug 18 and bullet 10. Since the flutes 26 provide a volume for the radial inward deformation of the metal jacket 20 during engraving, the overall energy stored in the bullet caused by engraving, as well as the friction between the bullet 10 and the rifle bore 36, is substantially reduced.

Figure 5:
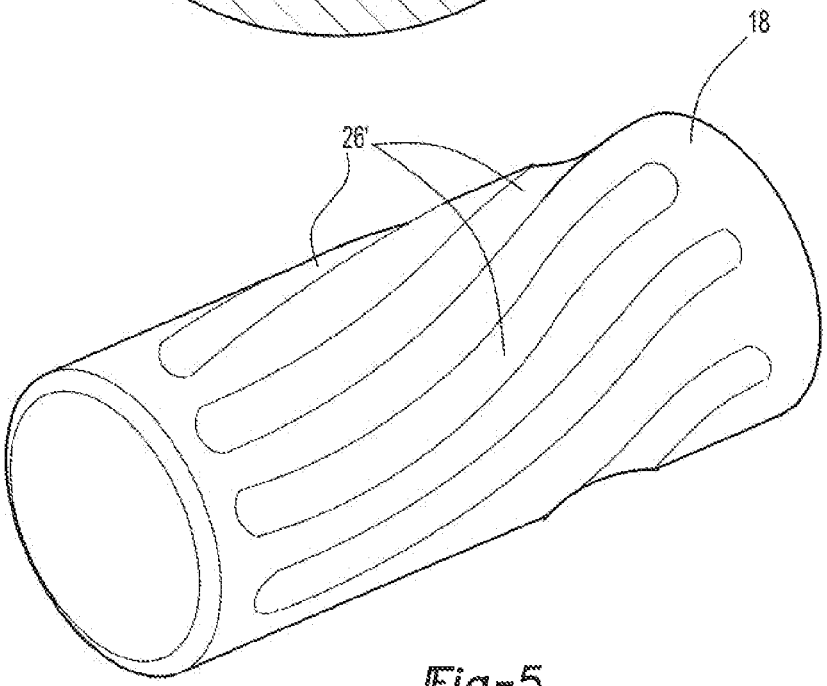
FIG. 5 is a view similar to FIG. 2, but illustrating a modification thereof.
Figure 6:
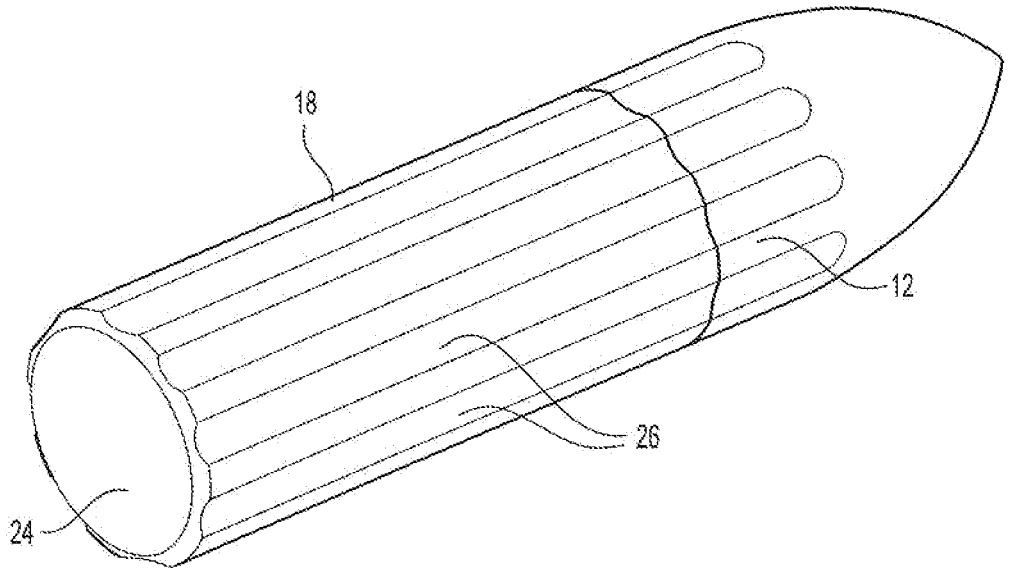
FIG. 6 is a view of a partially fluted slug and penetrator.

With reference now to FIG. 5, although the flutes 26 may run axially along the outer surface of the slug 18, alternatively the flutes 26 may have a helical angle as shown in FIG. 5 to match the helical angle of the barrel rifling 36. The flutes 26 may also extend partially along the rear portion of the penetrator 12 as shown in FIG. 6.

The reduction in the friction between the bullet 10 and the rifle bore 36 upon firing results in a higher exit velocity of the bullet from the barrel 32 than an identical bullet without flutes in the slug 18. This in turn increases the range and accuracy of the firearm.

From the foregoing, it can be seen that the present invention provides a novel jacketed bullet design. Having described my invention, however, many modifications thereto will become apparent to those skilled in the art to which it pertains without deviation from the spirit of the invention as defined by the scope of the appended claims.

The present invention can be described in a series of steps. The following series of steps describe the invention. First, forming a bullet from a slug having an outer surface. After which a penetrator, also having an outer surface, said penetrator being axially aligned to said slug, and a metal jacket disposed around the majority of said outer surface of said slug and said penetrator. Then disposing a plurality of helical flutes placed in an equidistant pattern longitudinally extending upon said outer surface of said slug and said penetrator. After which rifling the inside surface of a gun barrel to have an identical helical flute pattern of that of said slug and said penetrator so as to match that of said slug and said penetrator and said gun barrel being formed to a depth so as to engage the flutes of said slug and said penetrator through deformation of the metal jacket as caused by the gun barrel rifling. Then, firing said bullet from said gun barrel, whereby said metal jacket is deformed and pressed into the flutes of said slug and said penetrator in order to reduce the friction between said bullet and said gun barrel while said bullet traverses said gun barrel. It is also important to note that the penetrator is formed from a material denser than that of the slug.

We claim:

1. A bore resistance modification method which comprises:

forming a bullet from a slug having an outer surface, a penetrator also having an outer surface said penetrator being axially aligned to said slug, and a metal jacket disposed around the majority of said outer surface of said slug and said penetrator, disposing a plurality of helical flutes placed in an equidistant pattern longitudinally extending upon said outer surface of said slug and said penetrator, rifling the inside surface of a gun barrel to have an identical helical flute pattern of that of said slug and said penetrator so as to match that of said slug and said penetrator and said gun barrel being formed to a depth so as to engage the flutes of said slug and said penetrator through deformation of the metal jacket as caused by the gun barrel rifling, firing said bullet from said gun barrel, whereby said metal jacket is deformed and pressed into the flutes of said slug and said penetrator in order to reduce the friction between said bullet and said gun barrel while said bullet traverses said gun barrel.

2. The bore resistance modification method of claim 1 further comprising:

forming the slug from a material having a higher modulus than lead.

3. The bore resistance modification method of claim 1 further comprising:

forming the penetrator from a material denser than that of said slug.

4. The bore resistance modification method of claim 1 further comprising:

forming the metal jacket from copper.

* * * * *